US005992157A

United States Patent [19]

Gerhard

[11] Patent Number: 5,992,157

[45] Date of Patent: Nov. 30, 1999

[54] TEMPERATURE CONTROLLED TANK

[75] Inventor: Till Gerhard, Kirchen-Freusburg, Germany

[73] Assignee: Gerhard Engineering GmbH, Weitefeld, Germany

[21] Appl. No.: 09/025,309

[22] Filed: Feb. 18, 1998

[30] Foreign Application Priority Data

Feb. 24, 1997 [DE] Germany ..... 297 03 244 U

[51] Int. Cl.[6] ..... F17C 1/00

[52] U.S. Cl. ..... 62/45.1

[58] Field of Search ..... 62/45.1, 51.1

[56] References Cited

U.S. PATENT DOCUMENTS

| | | | |
|---|---|---|---|
| 3,319,433 | 5/1967 | Pauliukonis et al. | 62/45.1 |
| 3,895,497 | 7/1975 | McIntosh et al. | 62/45.1 |
| 4,860,545 | 8/1989 | Zwick et al. | 62/50.6 |
| 5,226,299 | 7/1993 | Moiseev | 62/45.1 |

FOREIGN PATENT DOCUMENTS

| | | |
|---|---|---|
| 1 223 132 | 8/1966 | Germany . |
| 1 960 929 | 3/1967 | Germany . |
| 88 00 536 | 4/1988 | Germany . |
| 41 17 273 | 8/1992 | Germany . |

*Primary Examiner*—Ronald Capossela
*Attorney, Agent, or Firm*—Foley & Lardner

[57] ABSTRACT

For heating or cooling the content of a tank, flow paths for a temperature controlling medium are provided in the form of longitudinal channels 13 of closed hollow profile separate from the tank envelope 12. The channels 13 are connected at either end to collecting channels 14 extending in the peripheral direction of the envelope 12 to form an internally continuous channel system. This channel system may be produced separately of the tank as a generally trough shaped structure and, after the tank has been placed therein, fixed to the tank and kept in close proximity to the tank envelope 12 by an insulation 16, 17 which surrounds the overall structure.

6 Claims, 1 Drawing Sheet

12
13
14
16
17

10
11
12
13
14
15
16
17

TEMPERATURE CONTROLLED TANK

BACKGROUND OF THE INVENTION

The temperature of tanks is usually controlled by feeding a temperature controlling medium through channels that are formed of half pipes welded to the tank envelope. If the temperature control involves heating, it is common to use steam as the temperature controlling medium. Tanks of this type are disclosed in DE 1,223,132 B1, DE 8,800,536 U1, and DE 4,117,273 A1.

DE 1,960,929 U1 discloses a temperature controlled tank wherein part of the tank envelope itself is constituted by a helically wound tube of rectangular cross-section. The inner side of the tube part may plated by welding.

While the known designs provide efficient heat exchange between the temperature controlling medium and the tank content due to the fact that part of the channel profile is formed by the tank envelope itself, there are problems in other respects.

One problem resides in the considerable weld lengths between the half tubes and the tank envelope, which involve the danger of leakage. Leaking temperature controlling medium causes corrosion of the tank envelope and damage to the insulation surrounding the envelope and the medium flow channels.

Leakage is prone to occur not only when the tank is first manufactured; at that time, leakage is relatively easy to detect and repair. The situation is considerably more problematic if leakage occurs at a later date as a result of stress between the flow channels and the tank envelope. Stress may result from mechanical load in operation, which leads to transitory or permanent deformation of the tank envelope, or from local temperature differences, such as when hot steam is suddenly supplied to a cold tank due to malfunction of the supply system.

In addition, welding of different materials is undesirable or even impossible. This is particularly true if the tank is made of a special steel.

Furthermore, welding the channels to the envelope not only involves considerable manufacturing expenditure; with a tank which is no longer new, contamination and/or deformation of the envelope make welding difficult, so that older tanks can hardly be retrofitted with a heating or cooling system.

SUMMARY OF THE INVENTION

It is an object of the invention to provide a temperature controlled tank which avoids the problems described above. A more specific object may be considered to reside in a temperature controlled tank that can be produced at low manufacturing expenditure. It is another object of the invention to provide a temperature control system for retrofitting existing tanks.

In view of these objects, the temperature controlled tank of the present invention has a tank envelope defining a tank axis, flow channels provided on the envelope, the channels being adapted for connection to means for supplying a temperature controlling medium, wherein each of the channels is made of a tube which has a closed hollow profile and is separate from the tank envelope.

The channels may be made of any available tube profile so that no welding is necessary other than at the ends of the channels where they are connected to a temperature controlling medium supply. The danger of leakage due to welding faults or thermal or mechanic stress is thus avoided.

If the channels are kept in close proximity to the tank envelope, which may be done by an insulation surrounding the envelope, sufficient heat exchange is ensured between the temperature controlling medium and the tank content. Even if there are locations without direct contact between the channel and the tank envelope, heat exchange is essentially confined to the envelope, thus to the tank content, because the surrounding insulation prevents any other heat exchange.

To provide a large surface for the heat exchange to the tank, each of the flow channels has a rectangular cross-section, with the sides of the cross-section extending tangentially of the tank envelope being longer than the sides extending perpendicularly thereto.

To enhance the temperature exchange, a wall of the channel facing the tank envelope may be provided with a bend extending parallel to the tank axis. Further, a heat conducting material may disposed between the channel wall facing the tank and the envelope.

In a preferred embodiment, a plurality of longitudinal channels extend parallel to the tank axis and a pair of collecting channels extend in a peripheral direction of the tank, the ends of the longitudinal channels being each connected to one of the collecting channels. The entire temperature control system may thus be produced separately and mounted on the tank as a unit. This results in a simplified manufacture and allows simultaneous production of the tank and the temperature control system.

The collecting channels preferably extend through an angle of no more than 180° of the tank circumference and cooperate with the longitudinal channels to form a trough shaped structure partially surrounding the tank. The longitudinal channels are straight and the collecting channels surround a cylindrical portion of the tank envelope. The temperature control system can thus be pre-manufactured in a particularly simple manner and only in a final step adapted to the respective tank. Bending of the tubes is unproblematic particularly if they are of circular cross-section.

DETAILED DESCRIPTION OF THE PREFERRED EMBODIMENT

Figure 2:
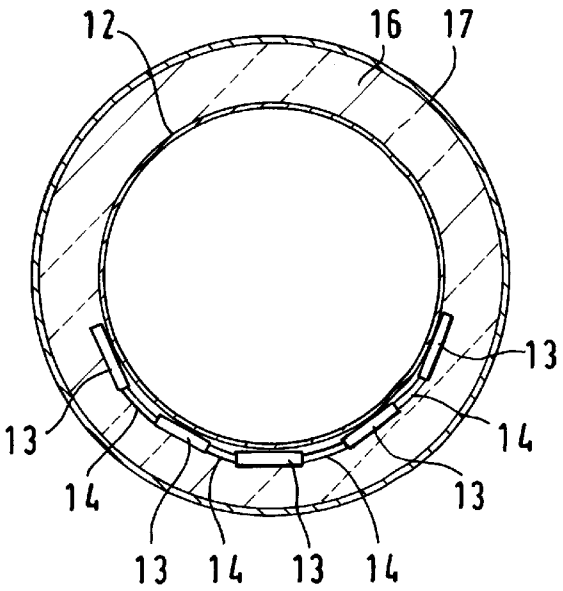
FIG. 2 is a cross-section through the tank shown in FIG. 1.
Figure 1:
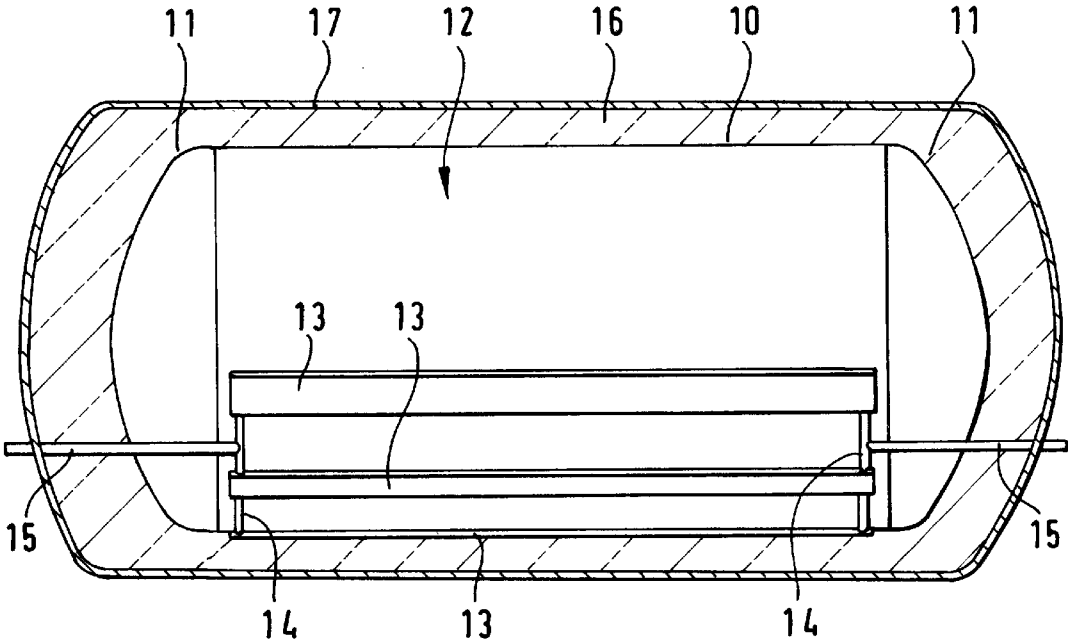
FIG. 1 is a side view of a temperature controlled tank.

The tank shown in the drawing has a tank envelope 12 including a cylindrical portion 10 and two tank bottoms 11.

A plurality of (five in the embodiment of FIG. 2) longitudinal flow channels 13 for a temperature controlling medium extend parallel to the tank axis substantially the entire length of the cylindrical part 10 of the envelope, with the ends of the channels 13 being each connected to a collecting channel 14. The two collecting channels 14 extend in the peripheral direction of the tank in the lower portion thereof through an angle of less than 180°. Each collecting channel 14 is provided with a pipe 15 for connection to a temperature controlling medium supply.

The temperature controlling medium may be a coolant, such as cooling water, or a heating medium, such as steam.

Each longitudinal flow channel 13 consists of a tube which has a hollow closed cross-section and is separate from the tank envelope 12. As shown in FIG. 2, the profile of the channels 13 is rectangular wherein the sides of the profile which extend tangential of the tank envelope 12 are longer than the sides extending perpendicularly thereto, in order to render that surface as large as possible which primarily takes part in the heat exchange.

The wall of the longitudinal channel 13 facing the tank envelope 12 is indented or bent (not shown in the drawing) along a line extending parallel to the tank axis so that this channel wall may contact the tank envelope 12 along two lines, thereby permitting the channel 13 to be disposed in even closer relationship to the envelope 12, with a correspondingly improved heat transfer. For the same reason, the space between the channel 13 and the envelope 12 may be filled with a heat conducting material (not shown), such as a so-called heat conducting paste or cement.

Either one of the two collecting channels 14 is formed of a tube of circular cross-section welded to the longitudinal flow channels 13 to form an internally continuous tube system including the longitudinal channels 13, the collecting channels 14 and the connecting pipes 15. This tube system may be pre-fabricated as an initially flat structure and welded together, with the collecting channels 14 being subsequently bent to conform to the curvature of the tank. Alternatively, the longitudinal channels 13 and connecting pipes 15 may be welded to pre-bent collecting channels 14.

A particularly simple way of manufacturing is obtained if each collecting channel 14, as shown in FIG. 2, is made of a plurality of pre-bent tubes of circular cross-section which are welded between respective pairs of adjacent longitudinal channels 13.

The tank is placed in the thus completed tubular system whereupon the overall structure is surrounded by an insulation layer 16. The exterior of the insulation layer 16 is surrounded by a thin sheet metal jacket 17. The purpose of this insulation 16, 17 is not only to prevent heat exchange to the outside but also to maintain the flow channels 13 in intimate contact with the tank envelope 12. Prior to the application of the insulation 16, 17, the tubular system may be forced against the tank envelope 12 by means of tightening straps or other suitable clamping elements (not shown).

What is claimed is:

1. A temperature controlled tank having its temperature regulated by a temperature controlling medium supply, the tank comprising:

a tank envelope defining a longitudinal tank axis; and a plurality of longitudinal flow channels provided outside of and separated from said envelope, said longitudinal flow channels being adapted to be connected to the temperature controlling medium supply, each of said longitudinal flow channels being made of a tube having a generally rectangular cross-section, a pair of first sides of said tube extending generally tangentially with respect to said tank envelope and being longer than a pair of second sides of said tube extending generally radially with respect to said tank envelope, pairs of adjacent longitudinal flow channels being connected by at least one collecting channel extending between and welded to facing ones of said second sides of the pair of adjacent longitudinal flow channels, said at least one collecting channel extending in an orthogonal plane with respect to said tank axis.

2. The tank of claim 1, wherein each of said longitudinal flow channels has one of said first sides facing said tank envelope, said one of said first sides having a bend extending parallel to said tank axis.

3. The tank of claim 1, wherein each of said longitudinal flow channels has one of said first sides facing said tank envelope, and a heat conducting material is disposed between said one of said first sides and tank said envelope.

4. The tank of claim 1, wherein said collecting channels connect said longitudinal flow channels around an angle of no more than 180° of a circumference of the tank envelope and cooperate with said longitudinal flow channels to form a trough shaped structure partially surrounding said tank envelope.

5. The tank of claim 1, wherein said collecting channels are formed by tubes of circular cross-section.

6. The tank of claim 1, further comprising:

an insulation layer surrounding said tank envelope, said longitudinal flow channels being held in contact with said tank envelope by said insulation layer.

* * * * *